US005486239A

United States Patent [19]

Nakayama et al.

[11] Patent Number: 5,486,239

[45] Date of Patent: Jan. 23, 1996

[54] METHOD OF MANUFACTURING MAGNETICALLY ANISOTROPIC R-T-B-M POWDER MATERIAL AND METHOD OF MANUFACTURING ANISOTROPIC MAGNETS USING SAID POWDER MATERIAL

[75] Inventors: Ryoji Nakayama; Takuo Takeshita; Yoshinari Ishill, all of Saitama, Japan

[73] Assignee: Mitsubishi Materials Corporation, Tokyo, Japan

[21] Appl. No.: 145,956

[22] Filed: Oct. 29, 1993

[30] Foreign Application Priority Data

Oct. 29, 1992 [JP] Japan ..... 4-314202

[51] Int. Cl.[6] ..... H01F 1/03

[52] U.S. Cl. ..... 148/101; 148/102; 148/104; 148/105; 148/122

[58] Field of Search ..... 148/101, 102, 148/104, 105, 122

[56] References Cited

U.S. PATENT DOCUMENTS 5,110,374 5/1992 Takeshita et al. ..... 148/101
5,143,560 9/1992 Doser ..... 148/101

FOREIGN PATENT DOCUMENTS 5-171204 7/1993 Japan ..... 148/101

*Primary Examiner*—John Sheehan
*Attorney, Agent, or Firm*—Vineet Kohli; Thomas R. Morrison

[57] ABSTRACT

A magnetically anisotropic R-T-B-M powder material which is starting with an R-T-B-M raw alloy material having a c-axis crystal orientation of an $R_2T_{14}B$-type intermetallic compound phase. In one embodiment, the starting material is compressed sintered in a magnetic field and recompressed in a magnetic field. In a second embodiment, the starting material is hot-pressed and homogenized. A method of manufacturing anisotropic magnets such as bond and full density magnets made from the magnetically anisotropic R-T-B-M powder material is disclosed.

19 Claims, No Drawings

METHOD OF MANUFACTURING MAGNETICALLY ANISOTROPIC R-T-B-M POWDER MATERIAL AND METHOD OF MANUFACTURING ANISOTROPIC MAGNETS USING SAID POWDER MATERIAL

BACKGROUND OF THE INVENTION

The present invention relates to a method of manufacturing a magnetically anisotropic powder material. More specifically, the present invention relates to a method of manufacturing a magnetically anisotropic R-T-B-M powder material which includes an R-T-B-M raw alloy material having a c-axis orientation of a $R_2T_{14}B$-type intermetallic compound phase for use in manufacturing anisotropic magnets which exhibit superior magnetic properties.

The present invention is also directed to a method of manufacturing anisotropic magnets from the magnetically anisotropic R-T-B-M powder material of the present invention. Magnets produced from such a magnetically anisotropic magnet powder exhibit superior anisotropic properties.

Prior art methods of manufacturing full-density anisotropic magnet comprise the steps of homogenizing an R-T-B-M raw alloy material, which yields an alloy having a recrystallized fine aggregate structure with a $R_2T_{14}B$-type intermetallic compound phase as the main phase. The alloy consists of R, T and B as its main components and further includes M in an amount of from 0.001 to 5.0 atomic %.

Such prior art methods comprise homogenizing by maintaining a R-T-B-M raw material at a temperature ranging from 600° to 1200° C. in an Ar atmosphere.

Alternatively, the alloy material is heated to a temperature ranging from 500° to 1,000° C. in a hydrogen gas atmosphere or in a mixed gas atmosphere consisting of an inert gas and a hydrogen gas, and maintaining it at this temperature to facilitate hydrogen occlusion. This is then followed by dehydrating the homogenized material by maintaining it in a vacuum or inert gas atmosphere at a temperature ranging from 500° to 1,000° C., then cooling and crushing the homogenized material.

Prior art methods of manufacturing anisotropic bond magnets utilize a bonding technique wherein the R-Fe-B-M magnet powder material is bonded to an organic binder or a metallic binder.

Prior art methods of manufacturing anisotropic full density magnets involve hot-pressing or subjecting to an HIP treatment a R-Fe-B-M magnet powder material at a temperature range of from about 600° to about 900° C. Such prior art methods are disclosed in Japanese Patent Provisional Publication No. 3129,702, Japanese Patent Provisional Publication No. 3-129,703, Japanese Patent Provisional Publication No. 4253,304 and Japanese Patent Provisional Publication No. 4245,403.

However, the R-Fe-B-M magnet powder obtained by any of the conventional manufacturing methods have insufficient magnetic anisotropy when compared to the original magnetic properties of the alloy material.

Additionally, bond and full-density magnets manufactured from such prior art magnet powder materials exhibit inferior magnetic anisotropy.

OBJECTS AND SUMMARY OF THE INVENTION

An object of the present invention is to provide a method of manufacturing a magnetically anisotropic R-T-B-M powder material wherein the R-T-B-M raw alloy material used to manufacture the magnetically anisotropic R-T-B-M powder material is characterized by a c-axis crystal orientation of an $R_2T_{14}B$-type intermetallic compound phase.

It is still a further object of the present invention to provide a method of producing anisotropic magnets from such a magnetically anisotropic powder material with superior anisotropic properties.

In order to achieve the above mentioned objects, the present invention provides a method of producing a magnetically anisotropic R-T-B-M powder material which includes the steps of maintaining in an Ar gas atmosphere, at a temperature of 600° to 1200° C., an R-T-B-M raw material alloy consisting essentially of, as main components, rare earth elements including Yttrium which is represented by "R", at least Fe and a component obtained by partially substituting Fe with Co, hereinafter referred to as "T" and B, and 0.01 to 5.0 atomic % M, where M is at least one of Ga, Hf, Nb, Ta, W, Mo, Al, Ti, Si and V, to homogenize the alloy. The R-T-B-M raw material alloy has a c-axis orientation of an $R_2T_{14}B$-type intermetallic compound phase.

This is followed by performing a hydrogen treatment of the homogenized alloy, cooling the alloy to obtain an alloy having a recrystallized fine aggregate structure with a $R_2T_{14}B$-type intermetallic compound phase, and finely grinding the alloy obtained.

The hydrogen treatment step comprises heating the homogenized alloy consisting of R, T and B as main components in a hydrogen atmosphere, mixed hydrogen/inert gas atmosphere, a vacuum atmosphere, and/or an inert gas atmosphere to a 500° C. from room temperature in this atmosphere, and maintaining the homogenized alloy at 500° C.

Hydrogen occlusion of the homogenized alloy is increased by heating the alloy in a hydrogen atmosphere or a mixed hydrogen/inert gas atmosphere to a predetermined temperature range of from about 500° to about 1,000° C. and maintaining it at this temperature for a predetermined time to accelerate phase transformation thereof. The hydrogen occluded by the alloy is forced out of the alloy by maintaining the alloy at a temperature range of from about 500° to about 1,000° C. in a vacuum atmosphere of up to 1 Torr to promote the phase transformation thereof.

According to another feature of the present invention, there is provided a method providing an R-T-B-M raw alloy material having a c-axis crystal orientation of an $R_2T_{14}B$-type intermetallic compound phase consisting of, as main components, at least one of a rare-earth element including Y (hereinafter referred to as "R"), one of a Fe and a component obtained by partially substituting Fe with Co (hereinafter referred to as "T"), and B; the R-T-B-M raw alloy material being of a type in which the main phase is an $R_2T_{14}B$-type intermetallic con, pound phase containing one or more of Si, Ga, Zr, Nb, Mo, Hf, Ta, W, Al, Ti and V (hereinafter referred to as "M") in an amount of from 0.001 to 5.0 atomic %, in any of a hydrogen atmosphere, a mixed hydrogen/inert gas atmosphere, a vacuum atmosphere and an inert gas atmosphere; heating the R-T-B-M raw alloy material from the room temperature up to 500° C. in the same atmosphere, and maintaining the R-T-B-M raw material alloy at a temperature of 500° C. for a predetermined time; further heating the R-T-B-M raw alloy material in one of a hydrogen atmosphere and a mixed hydrogen/inert gas atmosphere up to a prescribed temperature ranging from 500° to 1,000° C., and maintaining the raw alloy material at said prescribed temperature for a time sufficient to cause the R-T-B-M raw alloy material to occlude hydrogen; maintaining the R-T-B-M raw alloy material in a vacuum atmosphere of up to 1 Torr at the prescribed temperature for a time sufficient to cause the R-T-B-M raw alloy material to forcibly release hydrogen; and cooling and crushing the R-T-B-M raw alloy material to form a magnetically anisotropic R-T-B-M powder material.

According to another feature of the present invention, there is provided a method of manufacturing an anisotropic bond magnet which includes forming a magnetically anisotropic R-T-B-M powder material from an R-T-B-M raw alloy material having a c-axis crystal orientation of an $R_2T_{14}B$-type intermetallic compound phase; mixing the magnetically anisotropic R-T-B-M powder material with a predetermined amount of epoxy resin to provide a pre-form; subjecting the pre-form to a magnetic field of at least 25 KOe to provide a compressed powder; and finally thermosetting the thus-formed compressed powder at a prescribed temperature for a predetermined period of time to provide a bond magnet.

According to another feature of the present invention, there is provided a method of manufacturing an anisotropic full density magnet which includes forming a magnetically anisotropic R-T-B-M powder material from an R-T-B-M raw alloy material having a c-axis crystal orientation of an $R_2T_{14}B$-type intermetallic compound phase in a magnetic field to provide a preform compressed powder; hot-pressing the pre-form compressed powder under a predetermined pressure at a prescribed temperature range of from about 600° to about 900° C. for a predetermined period of time in a vacuum atmosphere with the direction of the magnetic filed the same as the direction of compression; and finally cooling rapidly the hot-pressed powder in an atmosphere of Ar gas to provide said full density magnet.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

The inventors have discovered that it is possible to manufacture a magnetically anisotropic R-Fe-B-M powder material by using an R-T-B-M raw material alloy which has a c-axis crystal orientation of an $R_2T_{14}B$-type intermetallic phase.

The raw material alloy which has a c-axis crystal orientation of an $R_2T_{14}B$-type intermetallic phase is usually a single crystal alloy.

The magnetically anisotropic R-T-B-M powder material is formed from an R-T-B-M raw alloy material consisting of, as main components, rare earth elements such as Yttrium (referred to as "R" hereinafter), Fe or a component obtained by partially substituting Fe with Co (referred to as "T" hereinafter) and B, and 0.01 to 5.0 atomic % M, where M includes at least one of Si, Ga, Zr, Nb, Mo, Hf, Ta, W, Al, Ti and V. Further, the alloy material is characterized by a crystal having a c-axis crystal orientation of an $R_2T_{14}B$-type intermetallic compound phase.

The R-T-B-M raw alloy material is preferably a magnetically anisotropic sinter which is formed in a magnetic field. Forming the material in a magnetic field and sintering imparts c-axis crystal orientation to the crystal alloy.

Alternatively, the raw material alloy can be a hot-processed mass which is formed by hot-pressing the raw material alloy in a magnetic field to incorporate c-axis crystal orientation to the raw material alloy.

Scraps of an $R_2T_{14}B$-type magnetic anisotropic sinter magnet can also be used as the magnetically anisotropic sinter. Similarly, scraps of a $R_2T_{14}B$-type magnetically anisotropic hot-pressed magnet may be used as the hot-pressed mass. The raw alloy material may be of any shape such as an ingot, bulk, flakes or particles. Part of Fe may be substituted by Ni, Cu, Cr, Mn or Zn. Part or all of B may be substituted by N, C, or O.

It is possible to manufacture a magnetically anisotropic R-Fe-B-M powder material by using an R-T-B-M raw alloy material having a c-axis crystal orientation of the $R_2T_{14}B$-type intermetallic compound phase.

It is thought that the c-axis orientation of the $R_2T_{14}B$-type intermetallic compound phase of the single crystal raw material alloy effects the recrystallized fine aggregate structure of the R-Fe-B-M magnet powder material obtained after hydration.

Even if the R-T-B-M raw material alloy has a c-axis crystal orientation of an $R_2T_{14}B$-type intermetallic compound phase, use of a fine grain raw material alloy fails to yield all R-Fe-B-M magnet powder with excellent magnetic anisotropy.

In such cases, magnetic properties of the R-FeB-M magnet powder can be substantially improved by growing the crystal grains having a c-axis crystal orientation of an $R_2T_{14}B$-type intermetallic compound phase, by homogenization. Homogenizing the crystal grains substantially improves the magnetic properties of the R-T-B-M raw alloy material. The size of the crystal grains that grow as a result of the homogenizing treatment, is preferably about 50 μm.

Magnetic properties of the resultant magnetically anisotropic powder can be further improved by heating the R-T-B-M magnetically anisotropic magnet powder material to a temperature range of from 300° to 1,000° C.

The present invention is described in detail below with reference to examples.

EXAMPLES

Ingots A through L having the chemical compositions of Table 1 were formed by melting and casting alloys in an atmosphere of Ar gas using a high-frequency furnace.

TABLE 1

| | Chemical composition (atomic %) |
|---|---|
| A | Nd: 11.9%, Co: 11.8%, B: 5.9%, Zr: 0.05%, Fe: bal. |
| B | Nd: 11.9%, Co: 11.8%, B: 5.9%, Ga: 0.2%, Fe: bal. |
| C | Nd: 11.9%, Co: 11.8%, B: 5.9%, Nb: 0.1%, Fe: bal. |
| D | Nd: 11.9%, Co: 11.8%, B: 5.9%, Zr: 0.05%, Ga: 0.1%, Fe: bal |
| E | Nd: 12.5%, Pr: 0.%, Co: 11.8%, B: 6.0%, Zr: 0.1%, Al: 0.5%, Fe: bal. |
| F | Nd: 12.5%, Pr: 0.5%, Co: 11.8%, B: 6.0%, Y: 0.3%, Ga: 1.0%, Fe: bal. |
| G | Nd: 12.5%, Pr: 0.5%, Co: 11.8%, B: 7.0%, Nb: 0.5%, Fe: bal. |
| H | Nd: 12.5%, Pr: 0.5%, Co: 11.8%, B: 7.0%, Zr: 0.1%, Ga: 0.3%, Fe: bal. |
| I | Nd: 13.2%, Pr: 0.03%, Co: 11.8%, B: 6.0%, Zr: 0.1%, Fe: bal. |
| J | Nd: 13.2%, Pr: 0.03%, Co: 11.81%, B: 6.0%, Mo: 0.4%, Ga: 0.1%, Fe: bal. |
| K | Nd: 13.2%, Pr: 0.03%, Co: 11.8%, B: 7.0%, Nb: 0.5%, Si: 0.2%, Fe: bal. |

TABLE 1-continued

| | Chemical composition (atomic %) |
|---|---|
| L | Nd: 13.2%, Pr: 0.03%, Co: 11.8%, B: 7.0%, Zr: 0.1%, Ga: 0.3%, Fe: bal. |

Example 1

A raw material alloy comprising a single crystal alloy was prepared by floating-zone-melting each of the ingots A to D reported in Table 1. Hydrogen was occluded from the raw material alloy by heating the alloy material to 750° C. from room temperature in a hydrogen atmosphere maintained at under 1 atm and maintaining it at 750° C. for a period ranging from 30 minutes to 4 hours hour.

Hydrogen occlusion from the homogenized ingot was then increased by heating the ingot to 850° C., and maintaining it at 850° C. to promote phase transformation. The hydrogen occluded by the ingot was then forced out of the ingot by maintaining the ingot at a temperature of 850° C. for at least one hour but no more than three hours while the atmosphere was changed to a $1\times10^{-1}$ vacuum atmosphere to promote the phase transformation thereof.

The resultant alloy was then cooled in an atmosphere of Ar gas and crushed to a size of up to 400 μm, to produce a magnetically anisotropic powder material of the present invention for manufacturing anisotropic magnets employing methods 1 through 4, as set forth in Table 2, of the present invention.

The anisotropic magnet powder material for use in manufacturing anisotropic magnet was mixed with 3 wt. % epoxy resin and compression formed in a magnetic field of 25 KOe to prepare a compressed powder. This pressurized powder was thermoset at 120° C. for one hour to prepare an anisotropic bond magnet. The magnetic properties of the prepared anisotropic bond magnet are shown in Table 2.

For preparing anisotropic full density magnet, the anisotropic magnet powder material thus obtained was compression-formed in a magnetic field of 25 KOe to yield a pressurized powder.

The resultant compressed powder was hot pressed at a pressure of 1 ton/cm$^2$ at 780° C. for 10 minutes in a vacuum atmosphere with the direction of the magnetic field the same as the direction of compression. The pressed material was then cooled rapidly in an Ar gas atmosphere to provide an anisotropic full-density magnet. The magnetic properties of the anisotropic full density magnet are shown in Table 2.

Example 2

Ingots E and H shown in Table 1 were crushed in a jaw crusher and a Brown mill to form a fine powder having an average grain size of 3.5 μm. The resultant fine powder was then compressed in a magnetic field for forming an object.

This compressed powder was sintered in a vacuum atmosphere by maintaining it at a temperature of at least 1,090° C. for two hours to provide a raw alloy material comprising an anisotropic sinter. The anisotropic sinter was homogenized by maintaining it in all Ar gas atmosphere at a temperature of 1,140° C. for ten hours. The average grain size of the homogenized anisotropic sinter is shown in Table 3.

Hydrogen was occluded from the homogenized anisotropic sinter by heating the homogenized sinter material to 700° C. from room temperature in an atmosphere of hydrogen at 1 atm and maintaining it at 700° C. for one hour. Hydrogen occlusion of the alloy material was increased by heating the material to a temperature of 700° C., and maintaining it at this temperature for one hour to promote phase transformation thereof.

The hydrogen occluded by the ingot was then forced out from the ingot by heating and maintaining the ingot at a temperature of 800° C. for one hour while the atmosphere was changed to $1\times10^{-1}$ vacuum atmosphere to accelerating phase transformation.

Methods 5 through 8, as set forth in Table 3, of the present invention were applied to the resultant alloy material which was then cooled in an Ar gas and crushed to a size of up to 400 μm to provide an anisotropic magnet powder for manufacturing anisotropic magnets.

In order to obtain a compressed powder for producing anisotropic magnets, the magnetically anisotropic R-T-B-M powder material was mixed with 3 wt. % epoxy resin and compression-formed in a magnetic field of 25 KOe. This compressed powder was thermoset at 120° C. for one hour to provide an anisotropic bond magnet. The magnetic properties of the prepared anisotropic bond magnet are shown in Table 3.

In order to produce an anisotropic full-density magnet, the magnetically anisotropic R-T-B-M powder material was compression-formed in a magnetic field of 25 KOe to prepare a compressed powder. The resultant powder was hot pressed under a pressure of 1 ton/cm$^2$ at 780° C. for 10 minutes in a vacuum atmosphere with the direction of the magnetic field the same as the direction of compression.

Then the hot pressed powder was cooled rapidly in an Ar gas atmosphere to provide an anisotropic full-density magnet. The magnetic properties of the anisotropic full density magnet are shown in Table 3.

TABLE 2

| Kind | | Ingot | Raw material alloy | Anisotropic bond magnet Br (kG) | iHc (kOe) | BHmax (MGOe) | Anisotropic full-density magnet Br (kG) | iHc (kOe) | BHmax (MGOe) |
|---|---|---|---|---|---|---|---|---|---|
| Method of the invention | 1 | A | Single-crystal alloy | 11.3 | 8.5 | 26.7 | 14.9 | 9.2 | 49.1 |
| | 2 | B | | 11.1 | 11.2 | 24.8 | 14.6 | 11.8 | 47.5 |
| | 3 | C | | 11.2 | 8.1 | 25.2 | 14.8 | 8.7 | 48.3 |
| | 4 | D | | 11.4 | 11.0 | 27.0 | 15.2 | 11.5 | 52.1 |

TABLE 3

| Kind | | Ingot | Average grain size if homogenized sinter (μm) | Anisotropic bond magnet Br (kG) | iHc (kOe) | BHmax (MGOe) | Anisotropic full-density magnet Br (kG) | iHc (kOe) | BHmax (MGOe) |
|---|---|---|---|---|---|---|---|---|---|
| Method of the Invention | 5 | E | 100 | 10.6 | 9.7 | 23.2 | 14.2 | 10.0 | 45.2 |
| | 6 | F | 120 | 10.4 | 14.8 | 23.0 | 13.7 | 14.4 | 41.8 |
| | 7 | G | 100 | 10.4 | 9.4 | 22.6 | 13.9 | 9.6 | 41.3 |
| | 8 | H | 150 | 10.7 | 14.2 | 24.5 | 14.4 | 13.7 | 47.2 |

Example 3

Ingots I to L were remelted to produce molten metal as reported in Table 1. The molted metal was then cooled at a very high rate in the single-roll type liquid quenching equipment to provide an amorphous ribbon.

This amorphous ribbon was hot-pressed by maintaining it at 710° C. for 15 minutes in a vacuum atmosphere. The amorphous ribbon was then plastically worked to ¼ height through biaxial compression at 750° C. to prepare a raw material alloy consisting essentially of a hot-worked body.

This hot-worked body was homogenized in an Ar gas atmosphere by maintaining it at a temperature of at least 1,120° C. for 30 hours.

Hydrogen was occluded from the homogenized hot-worked body by heating the hot-worked body to 720° C. from room temperature in an atmosphere of hydrogen at 1 atm and maintaining it at 700° C. for one hour to promote phase transformation thereof.

The hydrogen occluded by the ingot was forced out of the homogenized hot-body material by heating the ingot to a temperature of 800° C. and maintaining it at this temperature for one hour, while the atmosphere was changed to $1\times10^{-1}$ vacuum atmosphere to accelerating phase transformation.

Methods 9 through 12, as set forth in Table 4, of the present invention were applied to the thus obtained alloy material by cooling the alloy in an Ar gas atmosphere and crushing it to a size of up to 400 μm to provide an anisotropic magnet powder for manufacturing anisotropic magnets.

In order to obtain a compressed powder for producing anisotropic magnets, the magnetically anisotropic R-T-B-M powder material was mixed with 3 wt. % epoxy resin and compression-formed in a magnetic field of 25 KOe. This compressed powder was thermoset at 120° C. for one hour to provide an anisotropic bond magnet. The magnetic properties of the prepared anisotropic bond magnet are shown in Table 4.

In order to manufacture an anisotropic full-density magnet, the magnetically anisotropic R-T-B-M powder material was compression-formed in a magnetic field of 25 KOe to prepare a compressed powder. The resultant compressed powder was hot pressed under a pressure of 1 ton/cm$^2$ at 780° C. for 10 minutes in a vacuum atmosphere with the direction of the magnetic field the same as the direction of compression.

Then the hot pressed powder was cooled rapidly in an Ar gas atmosphere to finally yield an anisotropic full-density magnet. The magnetic properties of the anisotropic full density magnet are shown in Table 4.

TABLE 4

| Kind | | Ingot | Average grain size if homogenized sinter (μm) | Anisotropic bond magnet Br (kG) | iHc (kOe) | BHmax (MGOe) | Anisotropic full-density magnet Br (kG) | iHc (kOe) | BHmax (MGOe) |
|---|---|---|---|---|---|---|---|---|---|
| Method of the invention | 9 | I | 50 | 10.4 | 10.2 | 22.3 | 13.4 | 10.3 | 38.5 |
| | 10 | J | 80 | 10.0 | 13.7 | 20.5 | 13.2 | 13.7 | 37.0 |
| | 11 | K | 60 | 10.2 | 9.5 | 21.0 | 13.3 | 9.2 | 37.1 |
| | 12 | L | 100 | 10.4 | 14.0 | 22.5 | 13.6 | 14.2 | 40.2 |

Example 4

The raw alloy material which includes the anisotropic sinter was prepared from the ingots G and H of example 2 as shown in Table 1. Hydrogen was occluded from the raw material alloy under the same conditions as in the Example 2, without homogenizing, to forcibly release hydrogen for accelerating phase transformation. Thereafter, methods 13 and 14, as set forth in Table 5, of the present invention were applied which comprised cooling the alloy in an Ar gas atmosphere. The alloy material thus-obtained was crushed to a size of up to 400 μm to provide a magnetically anisotropic R-T-B-M powder material for manufacturing anisotropic magnets.

Using the magnetically anisotropic R-T-B-M powder material of the present invention, an anisotropic bond magnet and an anisotropic full-density magnet were prepared under the same conditions as in the Example 2.

The magnetic properties of the thus-prepared anisotropic bond magnet and anisotropic full-density magnet are shown in Table 5.

Example 5.

Hydrogen was occluded from an R-T-B-M raw material alloy consisting essentially of the hot worked body prepared from ingots K and L of the Example 3 as shown in Table 1, under the same conditions as in example 3, except that the raw material alloy was not homogenized. The hydrogen occluded by the material alloy was forcibly released to promote phase transformation.

This was followed by applying methods 15 and 16, as set forth in Table 5, of the present invention which included cooling the alloy material in an Ar gas atmosphere. The resulting alloy material was then crushed to a size of up to 400 μm to provide a magnetically anisotropic R-T-B-M powder material for manufacturing anisotropic magnets.

An anisotropic bond magnet and an anisotropic full-density magnet were prepared using the anisotropic magnet powder so obtained from the aforementioned steps under the same conditions as in the example 3. The magnetic properties of the thus prepared anisotropic bond magnet and anisotropic full-density magnet are shown in Table 5.

The results reported in tables 2 through 6 clearly demonstrate that the anisotropic bond magnet and the anisotropic full-density magnet manufactured according to the methods 1 through 16 of the present invention, using the magnetically anisotropic magnet powder material of the having a c-axis crystal orientation of the $R_2T_{14}B$-type intermetallic compound phase exhibit superior magnetic properties compared to the magnets prepared by conventional methods 1 and 2 which utilize ingots as the raw material.

According to the method of the present invention, it is possible to manufacture an magnetically anisotropic powder material for producing anisotropic magnets which exhibit superior magnetic properties.

TABLE 5

| | | Ingot | Raw material alloy (without homogenizing) | Anisotropic bond magnet Br (kG) | iHc (kOe) | BHmax (MGOe) | Anisotropic full-density magnet Br (kG) | iHc (kOe) | BHmax (MGOe) |
|---|---|---|---|---|---|---|---|---|---|
| Method of the invention | 13 | G | Anisotropic | 10.0 | 9.0 | 19.1 | 13.4 | 8.9 | 39.7 |
| | 14 | H | sinter | 10.3 | 14.5 | 20.8 | 13.3 | 14.1 | 38.5 |
| | 15 | K | Hot-worked | 9.8 | 9.2 | 18.1 | 12.9 | 8.7 | 34.6 |
| | 16 | L | body | 10.0 | 13.8 | 18.0 | 13.0 | 14.1 | 35.5 |

CONVENTIONAL CASE 1

Ingot H shown in Table 1 was homogenized by maintaining it at a temperature of 1,140° C. for ten hours in an Ar gas atmosphere. Hydrogen was occluded from the homogenized ingot H under the same conditions as set forth in example 2 followed by the forcible release of hydrogen from the ingot to promote phase transformation.

Conventional method 1 was then applied to the material alloy which included cooling the ingot in an Ar gas atmosphere followed by crushing it to a size of up to 400 μm to provide a magnet powder material for manufacturing anisotropic magnets.

Anisotropic magnets such as anisotropic bond magnets and anisotropic full-density magnets were prepared from the powder material produced according to the conventional method, under the same conditions as in the Example 2. The magnetic properties of the prepared anisotropic bond magnet and anisotropic full-density magnet are shown in Table 6.

Having described preferred embodiments of the invention, it is to be understood that the invention is not limited to those precise embodiments, and that various changes and modifications may be effected therein by one skilled in the art without departing from the scope or spirit of the invention as defined in the appended claims.

What is claimed is:

1. A method of manufacturing a magnetically anisotropic R-T-B-M powder material for an R-T-B-M anisotropic magnet having a recrystallized fine aggregate structure of an $R_2T_{14}B$ intermetallic compound phase comprising:

providing an R-T-B-M raw alloy material, in one of a hydrogen atmosphere, a mixed hydrogen/inert gas atmosphere, a vacuum atmosphere and an inert gas atmosphere, having a c-axis crystal orientation of an $R_2T_{14}B$ intermetallic compound phase consisting of, as main components, at least one of a rare-earth element including Y (hereinafter referred to as "R"), one of a Fe

TABLE 6

| | | Ingot | Raw material alloy | Anisotropic bond magnet Br (kG) | iHc (kOe) | BHmax (MGOe) | Anisotropic full-density magnet Br (kG) | iHc (kOe) | BHmax (MGOe) |
|---|---|---|---|---|---|---|---|---|---|
| Conventional method | 1 | H | Used in | 8.5 | 14.2 | 13.6 | 10.9 | 14.3 | 23.2 |
| | 2 | L | ingot form | 7.6 | 13.6 | 11.2 | 9.7 | 14.2 | 17.5 |

CONVENTIONAL CASE 2

Ingot L shown in Table 1 was homogenized by being maintained at a temperature of 1,120° C. for 30 hours in an Ar gas atmosphere. From the homogenized ingot L, an anisotropic bond magnet and an anisotropic full-density magnet was prepared under the same conditions as in example 3. The magnetic properties of the prepared anisotropic bond magnet and anisotropic full-density magnet are also shown in Table 6.

and a component obtained by partially substituting Fe with Co (hereinafter referred to as "T"), and B;

said R-T-B-M raw alloy material being of a main phase that is an $R_2T_{14}B$ intermetallic compound phase containing one or more of Si, Ga, Zr, Nb, Mo, Hf, Ta, W, Al, Ti and V (hereinafter referred to as "M") in an amount of from 0.001 to 5.0 atomic %;

one of heating said R-T-B-M raw alloy material from the room temperature up to 500° C. in said atmosphere, and maintaining said R-T-B-M raw material alloy at a temperature not exceeding 500° C. for about one hour after heating;

further heating said R-T-B-M raw alloy material in a hydrogen atmosphere or a mixed hydrogen/inert gas atmosphere up to a temperature ranging from 500° to 1,000° C., and maintaining said raw alloy material at said temperature for a time sufficient to cause said R-T-B-M raw alloy material to occlude hydrogen;

maintaining said further heated R-T-B-M raw alloy material in a vacuum atmosphere of up to 1 Torr at a temperature for a time sufficient to cause said R-T-B-M raw alloy material to release hydrogen; and cooling and crushing said vacuum maintained R-T-B-M raw alloy material to form a magnetically anisotropic R-T-B-M powder material.

2. The method of claim 1, wherein said R-T-B-M raw alloy material having a c-axis crystal orientation of an $R_2T_{14}B$ intermetallic compound phase is a single crystal alloy of an $R_2T_{14}B$ intermetallic compound phase.

3. The method of claim 1, wherein the step of providing said R-T-B-M raw alloy material includes providing an anisotropic sinter containing said R-T-B-M raw alloy material.

4. The method of claim 3, wherein the step of providing said sinter includes forming said $R_2T_{14}B$ intermetallic compound powder in a magnetic field to produce said c-axis crystal orientation.

5. The method of claim 1, wherein the step of providing said R-T-B-M raw alloy material includes providing a hot-worked mass.

6. The method of claim 5, wherein the step of providing said R-T-B-M raw alloy material includes hot-working said $R_2T_{14}B$ intermetallic compound powder.

7. The method of claim 1 wherein the step of providing said R-T-B-M raw alloy material includes providing at least one of an ingot, and powder.

8. The method of claim 1 wherein said B is partially substituted by at least one of N, C, and O.

9. The method of claim 1 wherein said B is completely substituted by at least one of N, C, and O.

10. A method of manufacturing a magnetically anisotropic material powder for an R-T-B-M anisotropic magnet having a recrystallized fine aggregate structure of an $R_2T_{14}B$ intermetallic compound phase comprising:

providing an R-T-B-M raw alloy material, in one of a hydrogen atmosphere, a mixed hydrogen/inert gas atmosphere, a vacuum atmosphere and an inert gas atmosphere, having a c-axis crystal orientation of an $R_2T_{14}B$ intermetallic compound phase consisting of, as main components, at least one of a rare-earth element including Y (hereinafter referred to as "R"), one of a Fe and a component obtained by partially substituting Fe with Co (hereinafter referred to as "T"), and B;

said R-T-B-M raw alloy material being of a main phase that is an $R_2T_{14}B$ intermetallic compound phase containing one or more of Si, Ga, Zr, Nb, Mo, Hf, Ta, W, Al, Ti and V (hereinafter referred to as "M") in an amount of from 0.001 to 5.0 atomic %;

homogenizing said R-T-B-M raw alloy material having a c-axis crystal orientation of a an $R_2T_{14}B$ intermetallic compound phase by maintaining said raw material alloy in an Ar gas atmosphere at a temperature of from 600° to 1,200° C.;

one of heating said R-T-B-M raw alloy material from the room temperature up to 500° C. in said atmosphere, and maintaining said R-T-B-M raw alloy material at a temperature not exceeding 500° C. for about one hour after heating;

further heating said R-T-B-M raw alloy material in a hydrogen atmosphere or a mixed hydrogen/inert gas atmosphere up to a temperature ranging from 500° to 1,000° C., and maintaining said R-T-B-M raw alloy material at said temperature for a time sufficient to cause said R-T-B-M raw alloy material to occlude hydrogen;

maintaining said further heated R-T-B-M raw alloy material in a vacuum atmosphere of up to 1 Torr at said temperature range for a time sufficient to cause said R-T-B-M raw alloy material to release hydrogen; and cooling and crushing said vacuum maintained R-T-B-M raw alloy material to provide a magnetically anisotropic R-T-B-M powder material.

11. The method of claim 10 wherein said B is partially substituted by at least one of N, C, and O.

12. The method of claim 10 wherein said B is completely substituted by at least one of N, C, and O.

13. The method of claim 10, wherein the step of providing said R-T-B-M raw alloy material intermetallic compound phase includes providing an anisotropic sinter containing said R-T-B-M raw alloy material.

14. The method of claim 13, wherein the step of providing said sinter includes forming said $R_2T_{14}B$ intermetallic compound powder in a magnetic field to produce a c-axis crystal orientation.

15. The method of claim 9, wherein the step of providing said R-T-B-M raw alloy material includes providing a hot-worked mass.

16. The method of claim 15, wherein the step of providing said hot-worked mass includes hot-pressing said $R_2T_{14}B$ intermetallic compound powder.

17. The method of claim 9 wherein said R-T-B-M raw alloy material having the c-axis crystal orientation of an $R_2T_{14}B$ intermetallic compound phase is homogenized at a temperature range of from about 1,050° to about 1,200° C. to provide an average crystal grain size of said R-T-B-M raw alloy material measuring at least 50 μm.

18. The method of claim 13 wherein said anisotropic sinter is homogenized at a temperature range of from about 1,050°to about 1,200° C. to provide an average crystal grain size of at least 5 μm.

19. The method of claim 15 wherein said hot-worked mass is homogenized at a temperature range of from about 1,050° to about 1,200° C. to provide an average crystal grain size of at least 50 μm.

* * * * *

UNITED STATES PATENT AND TRADEMARK OFFICE

CERTIFICATE OF CORRECTION

PATENT NO. : 5,486,239

DATED : January 23, 1996

INVENTOR(S) : Ryoji NAKAYAMA, Takuo TAKESHITA, Yoshinari ISHII

It is certified that an error appears in the above-identified patent and that said Letters Patent is hereby corrected as shown below:

Cover Page, Item [75] Inventors:, change "Ishill" to --Ishii--.

Column 12, Claim 18, line 54, change "5" to --50--.

Signed and Sealed this

Nineteenth Day of August, 1997

*Attest:*

*Attesting Officer*

BRUCE LEHMAN

*Commissioner of Patents and Trademarks*